US012385239B2

(12) United States Patent
Stein et al.

(10) Patent No.: US 12,385,239 B2
(45) Date of Patent: Aug. 12, 2025

(54) FLOW REGULATOR

(71) Applicant: Neoperl GmbH, Mullheim (DE)

(72) Inventors: Alexander Stein, Ihringen (DE); Gerhard Blum, Gutach (DE); Oliver Denzler, Bottmingen (CH)

(73) Assignee: Neoperl GmbH, Mullheim (DE)

( * ) Notice: Subject to any disclaimer, the term of this patent is extended or adjusted under 35 U.S.C. 154(b) by 1133 days.

(21) Appl. No.: 16/624,608

(22) PCT Filed: Jun. 20, 2018

(86) PCT No.: PCT/EP2018/066325
§ 371 (c)(1),
(2) Date: Dec. 19, 2019

(87) PCT Pub. No.: WO2019/048099
PCT Pub. Date: Mar. 14, 2019

(65) Prior Publication Data

US 2021/0277638 A1 Sep. 9, 2021

(30) Foreign Application Priority Data

Sep. 6, 2017 (DE) ..... 202017105379.2

(51) Int. Cl.
*E03C 1/084* (2006.01)
*E03C 1/086* (2006.01)

(52) U.S. Cl.
CPC ..... *E03C 1/084* (2013.01); *E03C 1/086* (2013.01)

(58) Field of Classification Search
CPC ..... E03C 1/08; E03C 1/084; E03C 1/086
USPC ..... 239/428.5
See application file for complete search history.

(56) References Cited

U.S. PATENT DOCUMENTS

| | | | | |
|---|---|---|---|---|
| 8,708,252 | B2 | 4/2014 | Blum et al. | |
| 2014/0053332 | A1 | 2/2014 | Cole | |
| 2017/0009436 | A1* | 1/2017 | Schurle | E03C 1/086 |
| 2017/0101768 | A1* | 4/2017 | Bosio | F16L 15/006 |
| 2017/0197223 | A1 | 7/2017 | Otoguro | |

FOREIGN PATENT DOCUMENTS

| | | | | |
|---|---|---|---|---|
| CN | 102206946 | A | 10/2011 | |
| CN | 202227407 | U | 5/2012 | |
| CN | 205577033 | U | 9/2016 | |
| CN | 106988383 | A | 7/2017 | |
| EP | 2915927 | | 9/2015 | |
| EP | 3153633 | | 4/2017 | |
| EP | 3208390 | A1 * | 8/2017 | E03C 1/084 |
| WO | 2013162359 | A1 | 10/2013 | |

* cited by examiner

*Primary Examiner* — Jason J Boeckmann
(74) *Attorney, Agent, or Firm* — Volpe Koenig

(57) ABSTRACT

A jet regulator (104) that has a jet regulator housing (1) which on the housing external circumference thereof has an external thread (2) for screw-fitting into an internal thread (3) in the water outlet (4) of a sanitary outlet fitting. The jet regulator (104) includes a housing part-region of the jet regulator housing (1) that is disposed on the outflow side of the external thread (2) in the direction towards the internal circumference of the water outlet (4) that is angled in such a manner that a drainage annular space (8) is formed between said housing part-region and the internal circumference of the water outlet (4).

35 Claims, 10 Drawing Sheets

115
1
2
22
21
9
29
27
23
18

FLOW REGULATOR

BACKGROUND

The invention relates to a jet regulator having a jet regulator housing which on the housing external circumference thereof, at a spacing from an outflow-side housing end side, has an external thread for screw-fitting into an internal thread in a water outlet of a sanitary outlet fitting.

Jet regulators in the most varied embodiments for shaping the water flowing out of the water outlet of a sanitary outlet fitting so as to form a homogenous and non-spraying water jet have already been achieved. To this end, the previously known jet regulators are assembled in the region of the water outlet on a sanitary outlet fitting.

A jet regulator of the type mentioned at the outset which on the housing external circumference of the jet regulator housing thereof has an external thread by way of which the jet regulator housing can be screw-fitted into an internal thread in the water outlet of a sanitary outlet fitting is already known from EP 3 153 633 A1. In order for the previously known jet regulator in the region of the annular gap lying between the jet regulator housing and the internal circumference of the water outlet not to have to be sealed by means of at least one separate annular seal made from an elastic material, the external thread in the case of the previously known jet regulator is provided directly below at least one aeration opening which penetrates the housing circumferential wall of the jet regulator housing and by way of which aeration opening besides the ambient air also the leakage water which was able to pass the annular gap by way of the screw connection between the external thread and the internal thread can moreover be suctioned into the housing interior. As soon as water flows through the previously known jet regulator and to this extent a negative pressure prevails on account thereof on the at least one aeration opening of said jet regulator, the previously known jet regulator is capable of entraining a partial-quantity of the leakage water passing the screw connection into the housing interior. However, since the aeration openings potentially extend only across part of the circumference of the jet regulator housing there is the risk that the balance of the leakage water passes the annular gap that remains between the housing external circumference of the jet regulator housing and the internal circumference in the water outlet of the sanitary outlet fitting and in a disturbing manner exits at the outflow-side end face of the water outlet.

SUMMARY

Therefore, there is in particular the object of achieving a jet regulator of the type mentioned at the outset which is distinguished by significantly improved sealing in the region between the housing external circumference of the jet regulator housing and the internal circumference in the water outlet of the sanitary outlet fitting.

The achievement according to the invention of this object in the case of the jet regulator of the type mentioned at the outset lies in particular in that a housing part-region of the jet regulator housing that is disposed on the outflow side of the external thread in the direction towards the internal circumference of the water outlet is angled in such a manner that a drainage angular space is formed between said housing part-region and the internal circumference of the water outlet.

The jet regulator according to the invention has a jet regulator housing which on the housing external circumference thereof has an external thread. This external thread is disposed at a spacing from an outflow-side housing end side of the jet regulator housing. By way of the external thread provided on the housing external circumference, the jet regulator according to the invention can be screw-fitted into an internal thread in the water outlet of a sanitary outlet fitting so as to shape the water exiting there so as to form a homogenous, non-spraying, and optionally also pearly-soft, water jet. It is provided according to the invention that a housing part-region of the jet regulator housing that is disposed on the outflow side of the external thread in the direction towards the internal circumference of the water outlet is angled in such a manner that a drainage annular space is formed between said housing part-region, which can be the housing end peripheral region, for example, and the internal circumference of the water outlet. Leakage water, which by way of the screw connection as well as by way of the annular zone between the housing external circumference and the internal circumference of the water outlet, makes its way up to a housing part-region and in particular up to the outflow-side end circumference peripheral region of the jet regulator housing can thus be collected in the drainage annular space which is formed between the housing part-the region that is disposed on the outflow side of the external thread and the internal circumference of the water outlet. The leakage water collected in the drainage annular space thus does no longer exit the annular zone in a disturbing manner from the annular zone remaining between the housing external circumference of the jet regulator and the internal circumference in the water outlet.

One particularly advantageous, because it is particularly tight, embodiment of the invention herein provides that the outflow-side end periphery of the housing part-region, and in particular the housing end periphery of the jet regulator housing, is configured as a lip seal which bears on the internal circumference of the water outlet, or lies close to the internal circumference of the water outlet. The outflow-side end periphery that is configured as a lip seal can bear tightly on the internal circumference of the water outlet. However, it is also possible for said end periphery to only lie close to the internal circumference of the water outlet in such a manner that leakage water collected in the drainage annular space is retained there by virtue of the capillary forces, or that an annular gap remaining between the lip seal, on the one hand, and the internal circumference of the water outlet, on the other hand, is tightly closed due to the formation of lime scale which is functionally inconsequential and thus potentially desirable in this region.

By virtue of the particular design features thereof, the jet regulator according to the invention is comparatively insensitive in relation to a formation of lime scale even in the region of the jet regulator housing of said jet regulator. One preferred embodiment according to the invention therefore provides that the jet regulator is configured as a jet aerator which mixes the water flowing therethrough with ambient air and to this end, in a housing portion of the jet regulator housing that is disposed on the outflow side of the external thread, has at least one aeration opening that is provided on the housing circumference or on the housing end side of the jet regulator housing.

Jet-forming structures are required in the housing interior in order for the jet regulator to be able to positively shape the water flowing through the jet regulator housing thereof. In order for such jet-forming structures to be able to be inserted into the jet regulator housing in a simple manner, it is advantageous for the jet regulator housing two have at least two housing parts that are preferably capable of being connected to one another in a releasable manner.

The external thread herein can be provided on a housing part that is disposed on the inflow side. However, an embodiment in which a first housing part that is disposed on the outflow side supports the external thread is preferable.

The water flowing through the jet regulator housing can be particularly effectively shaped when the outflow-side first housing part on the inflow side is capable of being connected, particularly in a releasable manner, to a second housing part of the jet regulator housing, said second housing part supporting a jet splitter which splits the water flowing therethrough into a multiplicity of individual jets.

One preferred embodiment according to the invention herein provides that the jet splitter is configured as a diffuser which has a cup-shaped jet splitter insert which on the cup circumference of the cup shape thereof has a plurality of splitter openings and which has a cup base which is configured as an impact face that deflects the inflowing water towards the splitter openings.

In order for the water flowing out into the jet regulator housing to first be divided into individual jets and in order for the individual jets to subsequently be accelerated in such a manner that a negative pressure is created at the outflow side of the diffuser, it is advantageous for the second housing part to encompass the jet splitter insert, and for the second housing part at least in the region of the cylindrical openings to taper, in particular conically, in such a manner that an annular gap which on the outflow side tapers towards an annular opening that opens into the housing interior is formed between the jet splitter insert and the housing internal circumference of the second housing part.

One preferred refinement according to the invention provides that a sleeve-shaped guide wall is provided in the jet regulator housing, and that at least one aeration duct which from at least one aeration opening that is disposed on the housing outflow side or on the housing circumference leads to the housing interior is provided between the housing internal circumference of the jet regulator housing and the guide wall. In the case of this refining design embodiment, the jet regulator according to the invention has an external surface formed by the housing external circumference, and an internal surface formed by the guide wall. Since the at least one aeration duct and the at least one aeration opening can thus be disposed on the internal surface of the jet regulator that is configured as a jet aerator, any accelerated formation of lime scale in the annular zone between the housing external circumference of the jet regulator housing and the internal circumference in the water outlet is effectively counteracted.

In order for the drainage annular space be continuously emptied during the operation of the jet regulator according to the invention, it is advantageous for at least one drainage opening which from the drainage annular space leads to the aeration duct or to at least one of the aeration ducts to be provided in the part-region of the housing wall of the jet regulator housing that is disposed between the outflow-side housing end side and the external thread. Ambient air that is suctioned through the aeration duct into the housing interior of the jet aerator can thus entrain leakage water from the drainage openings, said drainage water in the housing interior mixing with the water flow flowing through the jet regulator housing.

In order for as little leakage water be allowed to seep through the annular zone between the housing external circumference and the internal circumference in the water outlet so as to have to trap ideally little leakage water in the drainage annular space and cause a great pressure loss in the region of the annular zone mentioned, said great pressure loss likewise counteracting any seepage of leakage water, it is expedient for the jet regulator housing on the housing external circumference thereof as an external thread to have a thread profile which at least in regions deviates from a thread groove that in a helical manner continuously encircles a cylindrical wall and which in said region interacts in a shape-adapted manner with the internal thread provided in the water outlet. Additionally or alternatively, it can be advantageous for the jet regulator housing to have at least one cross-sectional widening which is materially identical and moulded so as to be integral to the housing portion of the jet regulator housing that supports the external thread, which cross-sectional widening is capable of being brought to bear on the end side and/or the internal circumferential side of the water outlet.

By virtue of these particular design features of the jet regulator housing, any uncontrolled exiting of leakage water through the annular zone disposed between the external circumference of the jet regulator housing and the internal circumference of the water outlet is effectively avoided at almost all operating conditions even when the jet regulator according to the invention is designed without any additional elastic annular seals for sealing the jet regulator housing in an axial or radial manner. By way of the jet regulator according to the invention, the annular zone mentioned above is reliably tight even when the internal thread in the water outlet cannot be fabricated with high precision, and when the annular shoulder in the water outlet required for axial sealing is to be dispensed with in favour of a lower manufacturing complexity in the production of the outlet fitting.

A positively sealing embodiment according to the invention that is simple in terms of construction, in which the external thread forms a thread profile which at least in regions deviates from a thread groove that in a helical manner continuously encircles a cylindrical wall provides that the external envelope circle of the external thread on the jet regulator housing that is specified for screw-fitting into the internal thread moulded in the cylindrical water outlet widens in a preferably conical manner towards the outflow side. In the case of this embodiment, the external thread by way of the conically widened thread portion thereof digs its way deep into the encircling thread groove of the internal thread provided in the water outlet in such a manner that said annular zone between the external thread on the housing external circumference, on the one hand, and the internal thread in the water outlet, on the other hand, is effectively sealed in relation to any seepage of leakage water.

Any seepage of leakage water is, if at all, to be expected by way of the screw connection between the internal thread and the external thread. In order for the thread turns of said screw connection to be secured in relation to any seepage of leakage water, it is expedient for at least one moulding which serves as a liquids bulkhead and which projects into at least one thread groove of the external thread to be provided on the housing external circumference of the jet regulator housing.

In order for the moulding serving as a liquids bulkhead to be able to dig deep into the thread groove of the internal thread provided on the water outlet, it is expedient for the at least one moulding to reach up to the envelope circle enveloping the external thread or at least in regions to project beyond said envelope circle.

Particularly effective sealing is facilitated when the at least one moulding is configured as a separation wall that extends across at least two neighbouring thread grooves of the external thread.

An effectively sealing embodiment according to the invention which is comfortable to handle and easy to produce and in which the separation wall represents a deviation from a thread groove that in a helical manner continuously encircles the cylindrical wall in the external thread herein provides that the at least one separation wall runs so as to be at least axially parallel to the housing longitudinal axis of the jet regulator housing.

Additionally or alternatively, the deviation in the external thread provided according to the invention can however also be designed as at least one moulding configured so as to be cam-shaped, wherein the cam-shaped moulding in the thread groove extends approximately in the groove longitudinal direction.

However, it is also possible for the thread profile of the external thread that projects beyond the thread groove to widen at least in regions and preferably in an outflow-side thread portion, such that the external thread by way of said thread portion widening at the outflow side can in a sealing manner dig deep into the internal thread.

In order for a cross-sectional widening be provided on the housing external circumference of the jet regulator housing, one exemplary embodiment according to the invention provides that the at least one cross-sectional widening projects in a flange-type manner on the housing external circumference of the jet regulator housing.

The at least one flange-type cross-sectional widening in the housing circumferential direction of the jet regulator housing herein can extend across at least one drainage opening.

In order for only a minor proportion of leakage water, if at all, to be able to seep into the drainage annular space, it is expedient for the at least one flange-type cross-sectional widening on the housing external circumference of the jet regulator housing to be provided between the external thread and the at least one drainage opening.

One particularly tight embodiment according to the invention provides that the flange-type cross-sectional widening is configured as an annular flange that encircles the jet regulator housing.

One preferred embodiment according to the invention provides that the at least one flange-type cross-sectional widening is configured as a screw-fitting detent which delimits the screw-fitting of the external thread into the internal thread in the water outlet of the outlet fitting.

The functionally correct operation of the jet regulator according to the invention is also secured in relation to unauthorized manipulations when a mesh or net structure from webs that intersect one another at intersection nodes is moulded so as to be integral to the guide wall on the outflow side. This outflow-side mesh or net structure, which can also serve as a flow rectifier which combines the water that is in particular mixed with ambient air so as to form a homogenous outflowing water jet, and the structures lying behind said mesh or net structure in the housing interior, can thus not be forced upwards counter to the flow direction of the water.

In order to be able to screw-fit the jet regulator according to the invention in a simple manner in the water outlet of a sanitary outlet fitting, it is advantageous for the guide wall to be connected in a rotationally fixed and in particular integral manner to the jet regulator housing and in particular to the first housing part on the outflow side, and for at least one tool engagement face for a driving tool be provided on the guide wall and/or on the mesh or net structure.

One embodiment according to the invention which is particularly simple to produce and comfortable to handle provides herein that, in the mesh or net structure, there is provided at least one slot-shaped recess which serves for the insertion of a coin used as the driving tool or any other driving tool and which is delimited by opposite slot longitudinal walls which form tool engagement faces for the driving tool.

Since the annular zone that in the case of the jet regulator according to the invention is situated between the housing external circumference of the jet regulator housing and the internal circumference of the water outlet is positively sealed, one preferred embodiment according to the invention provides that the jet regulator is designed so as to be free of an annular seal and makes do without an annular seal that is produced from an elastic material so as to be separate from the jet regulator housing.

In order for the water arriving in individual jets from the jet splitter to be shaped so as to form a homogenously exiting, non-spraying and optionally also pearly-soft water jet at the outflow end side of the jet regulator according to the invention, it is expedient for at least one insert part in the flow direction to be disposed downstream of the jet splitter so as to be spaced apart from the latter, said insert part having a mesh or net structure from webs that intersect one another at intersection nodes.

One particularly advantageous exemplary embodiment according to the invention provides herein that the mesh or net structure(s) that is/are provided in the at least one insert part and/or is/are moulded so as to be integral to the guide wall has/have throughflow openings which have a honeycomb-shaped and/or hexagonal available opening cross section.

According to one other advantageous exemplary embodiment it is provided that the mesh or net structure(s) that is/are provided in the at least one insert part and/or is/are moulded so as to be integral to the guide wall is/are formed from at least two concentrically encircling webs which are connected to a group of radial webs.

In order for the mesh or net structure(s) that is/are provided in the at least one insert part and/or is/are moulded so as to be integral to the guide wall in terms of the available opening cross section thereof to delimit approximately rectangular and preferably square throughflow openings, it is advantageous for the mesh or net structure(s) that is/are provided in the at least one insert part and/or is/are moulded so as to be integral to the guide wall to have a group of axially parallel first webs which intersect a group of axially parallel second webs which are disposed at an angle and preferably at a right angle in relation to said group of axially parallel first webs.

However, it is also possible for the mesh or net structure(s) that is/are moulded so as to be integral in the insert part and/or to the guide wall is/are formed by webs which are mutually disposed at an angle in such a manner that said mesh or net structure(s) is/are formed in an ornamental manner from throughflow openings that in terms of the available cross section thereof are non-uniformly shaped.

BRIEF DESCRIPTION OF THE DRAWINGS

Refinements according to the invention are derived from the claims in conjunction with the drawing as well as the description. The invention will be described in yet more detail hereunder by means of preferred exemplary embodiments.

In the drawings:

in FIG. 6A, and wherein FIG. 6A shows the jet regulator in a plan view of the inflow side thereof;

FIG. 13 shows the jet regulator designed while using the jet regulator housing shown in FIG. 11, said jet regulator here too being screw-fitted into the water outlet of a sanitary outlet fitting, in a longitudinal section through the section plane XIII.-XIII. according to FIG. 13A, wherein

FIG. 23A to FIG. 23C show the jet regulator from FIG. 15 to FIG. 22 in views of details in the region of the screw connection thereof, wherein FIG. 23A shows the jet regulator, not yet completely screw-fitted into the water outlet, in the region of the external thread thereof that interacts with the internal thread in the water outlet, and FIG. 23B shows the screw connection interacting between the external thread and the internal thread in the water outlet, wherein the thread deviation provided on the outflow-side end region of the external thread begins to cut into the internal thread, and wherein the screw connection between the external thread on the jet regulator housing and the internal thread in the water outlet is illustrated in the screw-fitted terminal position in FIG. 23C;

DETAILED DESCRIPTION

Figure 2:
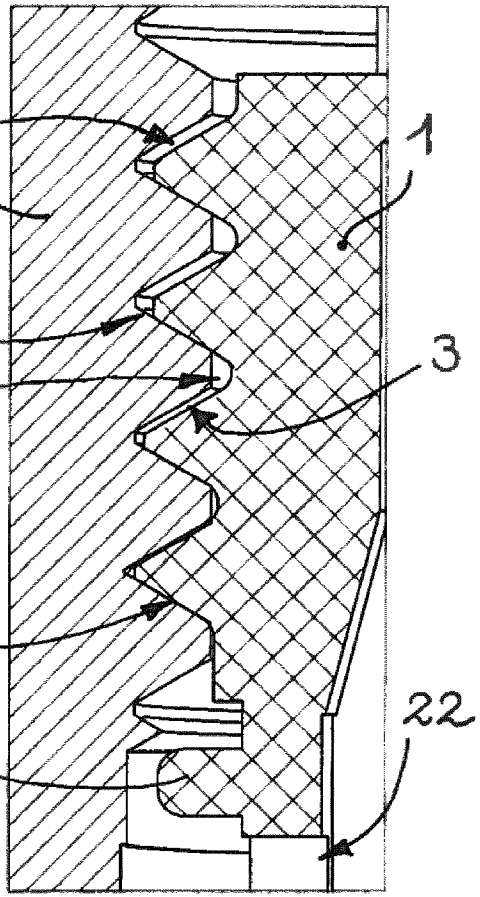
FIG. 2 shows the jet regulator housing from FIG. 1 screw-fitted into an internal thread in the water outlet, in a longitudinal section of a detail in the region of the external thread.

Various embodiments 101, 104, 111, 115, 127, and 130 of a jet regulator are illustrated in FIGS. 1 to 32. While only the jet regulator housing of the jet regulator 101 is illustrated, the jet regulators 104, 111, 115, 127, and 130 in FIGS. 6, 13, 22, 25, 28, and 31 are shown in longitudinal sections which in an exemplary manner show all essential component parts of such a jet regulator.

The jet regulators 101, 104, 111, 115, 127, and 130 shown here have a jet regulator housing 1 which on the housing external circumference thereof has an external thread 2. By way of the external thread 2 provided on the housing external circumference, the jet regulators 101, 104, 111, 115, 127, and 130 can in each case be screw-fitted into an internal thread 3 in the water outlet 4 of a sanitary outlet fitting so as to shape the water exiting there so as to form a homogenous, non-spraying and optionally also pearly-soft water jet. In order for the annular zone 5 remaining between the housing external circumference of the jet regulator housing 1 and the internal circumference of the water outlet 4 to be sealed in relation to any uncontrolled exiting of leakage water, the jet regulators 101, 104, 111, and 115 as the external thread 2 have a thread profile which at least in regions deviates from a thread groove that in a helical manner continuously encircles a cylindrical wall. The external thread 2, in said thread profile that at least in regions is designed in a deviating manner, interacts in self-tapping or rather self-adapting manner with the internal thread 3 provided in the water outlet 4 such that said screw connection seals particularly positively in said region. Additionally, or as here alternatively, at least one cross-sectional widening 6 or 7, respectively, is provided in the case of the jet regulators 127 and 130, said cross-sectional widening 6 or 7, respectively, being materially identical with the housing portion of the jet regulator housing that supports the external thread 2 and being moulded so as to be integral thereto, and said cross-sectional widening 6 or 7, respectively, being capable of being brought to bear in a sealing manner on the end side and/or the internal circumferential side of the water outlet 4. By virtue of these particular design features of the jet regulators shown here, any uncontrolled exiting of leakage water through the annular zone 5 provided between the housing external circumference of the jet regulator housing 1 and the internal circumference in the water outlet 4 is effectively avoided at almost all operating conditions even when the jet regulators, like here, are designed without additional elastic annular seals for sealing the jet regulator housing 1 in an axial or radial manner. The annular zone mentioned above in the case of the jet regulators 101, 104, 111, 115, 127, and 130 is reliably tight even when the internal thread 3 in the water outlet cannot be fabricated with high precision, and when the annular shoulder in the water outlet 4 required for axial sealing is to be dispensed with in favour of a lower manufacturing complexity in the production of the outlet fitting.

As becomes evident from the longitudinal sections in FIGS. 6, 13, 22, 26, 28, and 31, a housing end peripheral region of the jet regulator housing 1 that is disposed on the outflow side of the external thread 2 in the direction towards the internal circumference of the water outlet 4 is angled in such a manner that a drainage annular space 8 is formed between said housing end peripheral region and the internal circumference of the water outlet 4.

The jet regulators 101, 104, 111, 115, 127, and 130 here are in each case configured as a jet aerator which mixes the water flowing therethrough with ambient air. The jet regulators 101, 104, 111, 115, 127, and 130 configured as jet aerators have at least one aeration opening 9 which is disposed on the outflow side of the external thread 2 and is configured so as to be open towards the outflow-side housing end side.

The jet regulator housing 1 of the jet regulators 101, 104, 111, 115, 127, and 130 illustrated here has at least two housing parts 10, 11 that are capable of being releasably connected to one another and of which a first housing part 10 disposed on the outflow side supports the external thread 2. This outflow-side first housing part 10 at the inflow side is releasably connected to a second housing part 11 of the jet regulator housing 1, said second housing part 11 supporting a jet splitter which splits the water flowing therethrough into a multiplicity of individual jets.

The jet splitter of the jet regulator 111 shown in FIGS. 11 to 14 here is configured as a perforated plate 30 which has a multiplicity of splitter openings 31 and in which the second housing part 11 is integrally moulded. The splitter openings 31 that are situated in the perforated plate 30 that is oriented transversely to the flow direction form cross-sectional constrictions which preferably taper in the flow direction and in which the inflowing water is imparted an acceleration in terms of velocity. Due to this increase in velocity, a negative pressure by way of which ambient air can be suctioned through the housing interior of the jet regulator housing 1 is created on the outflow side of the perforated plate 30. In order for said ambient air to be intensively mixed with the water flowing through the housing interior, at least one insert part 32, 33 is provided on the outflow side of the perforated plate 30 so as to be spaced apart from the latter, said insert parts 32, 33 having in each case one mesh or net structure from webs that intersect one another at intersection nodes. The inflowing water in the mesh or net structure of said insert parts 32, 33 is additionally divided in such a manner that said water can positively mix with the suctioned ambient air before said water in a flow rectifier at the outlet end side of the jet regulator 111 is combined so as to form a homogenous, non-spraying and pearly-soft outlet jet.

By contrast, the jet splitter of 101, 104, 115, 127, and 130 is configured as a diffuser which has a cup-shaped jet splitter insert 12 which on the cup circumference of the cup shape thereof has a plurality of splitter openings 13 and which has a cup base 14 which is configured as an impact face that deflects the inflowing water towards the splitter openings 13.

The second housing part 11 encompasses the jet splitter insert 12 of the jet splitter. The second housing part 11 in terms of the available housing cross section thereof comically tapers in such a manner that an annular gap 15, which on the outlet side tapers towards an annular opening 16 that opens into the housing interior, is formed between the jet splitter insert 12 and the housing internal circumference of the second housing part 11.

A sleeve-shaped guide wall is provided in the jet regulator housing 1, at least one aeration duct 18 being provided between said guide wall 17 and the housing internal circumference of the jet regulator housing 1. This aeration duct 18 from the at least one aeration opening 9 disposed on the housing outflow side leads to the housing interior. Since the water divided into individual jets in the jet splitter is imparted an increase in velocity in the annular gap 15, a negative pressure which suctions ambient air from the outside through the aeration duct 18 into the part-region of the housing interior space that serves as a mixing zone 20 is created according to Bernoulli's principle on the outflow side of the annular gap 15 in the region of the annular opening 16. In said mixing zone 20 the water flowing therethrough is mixed with the suctioned ambient air.

As can be readily seen in the longitudinal sections according to FIGS. 6, 13, 22, 25, 28, and 31, the housing part-region or housing end peripheral region of the jet regulator housing 1 disposed on the outflow side of the external thread 2 in the direction towards the internal circumference of the water outlet 4 is angled in such a manner that the drainage annular space 8 is formed between said housing end wall region and the internal circumference of the water outlet 4. In order for the leakage water seeping through the annular zone 5 between the housing external circumference of the jet regulator housing 1 and the internal circumference of the water outlet 4 to be able to be readily retained in the drainage annular space 8, the outflow-side housing end periphery of the jet regulator housing 1 is configured as a lip seal 21 which could bear on the internal circumference of the water outlet 4, however here only lies close to the internal circumference of the water outlet 4. On account of the capillary forces in this region, and on account of a rapid formation of limestone in the annular gap between the housing end periphery configured as the lip seal 21 and the internal circumference in the water outlet 4, said annular gap is yet additionally sealed.

As can be seen in the longitudinal sections according to FIGS. 6, 13, 22, 25, 28, 31, at least one drainage opening 22 which leads from the drainage annular space 8 to the aeration duct 18 is provided in the part-region of the housing wall of the jet regulator housing 1 that is disposed between the outflow-side housing end periphery and the external thread 2. The air suctioned through the aeration duct 18 can thus entrain the leakage water exiting the drainage annular space 8 by way of the drainage openings 22 and guide said leakage water into the housing interior space where said leakage water is mixed with the water flowing therethrough.

A mesh or net structure 23 from webs that intersect one another at intersection nodes is integrally moulded to the guide wall 17 at the outflow side. The throughflow holes 24 of said mesh or net structure 23, which are formed between neighbouring webs and which here have a honeycomb-shaped hexagonal available hole cross section, preferably have a longitudinal extent that is larger in comparison to the hole cross section, but at least have a longitudinal extent which suffices for bringing together the water mixed in the housing interior so as to form a homogenous water jet. The guide wall 17 is connected in a rotationally fixed and preferably integral manner to the jet regulator housing 1 and in particular to the outflow-side first housing part 10. At least one tool engagement face for a driving tool is provided herein on the guide wall 17. To this end, at least one slot-shaped recess 29 for inserting a coin used as the driving tool, or any other driving tool, is provided in the mesh or net structure 23. Said recess 29 is delimited by opposite slot longitudinal walls. These slot longitudinal walls of the recess 24 form tool engagement faces for the driving tool.

Figure 1:
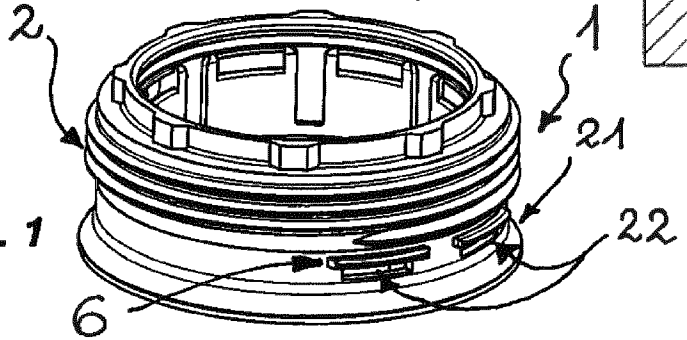
FIG. 1 shows the jet regulator housing, illustrated in a perspective manner, of a jet regulator which on the jet regulator housing thereof supports an external thread by way of which the jet regulator is capable of being screw-fitted into an internal thread on the water outlet of a sanitary outlet fitting, wherein the housing end peripheral region disposed on the outflow side of the external thread is angled outwards in such a manner that a drainage annular space is formed between said housing end peripheral region and the internal circumference of the water outlet (not illustrated in more detail here)
Figure 3:
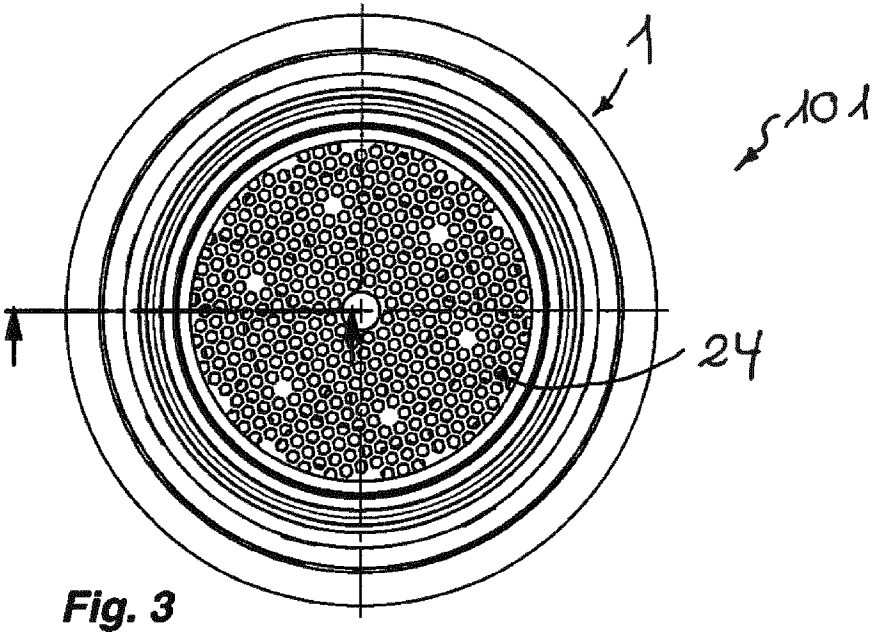
FIG. 3 shows the jet regulator housing from FIGS. 1 and 2 in a plan view of the outflow-side housing end face of said jet regulator housing.
Figure 4:
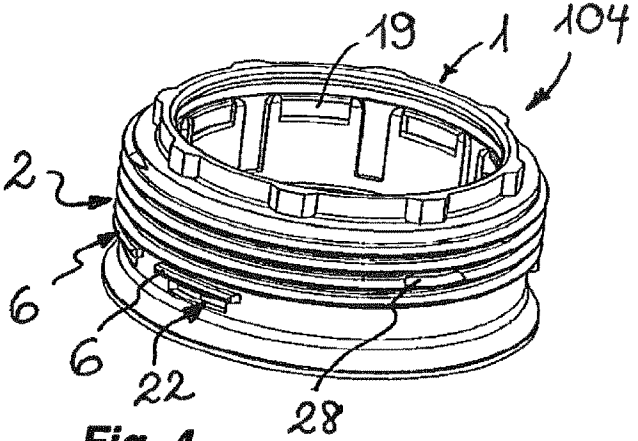
FIG. 4 shows the jet regulator housing of a further jet regulator in a perspective illustration, wherein an external thread which in a thread groove has at least one moulding that projects in the manner of a cam is provided on the housing external circumference of the jet regulator housing.
Figure 5:
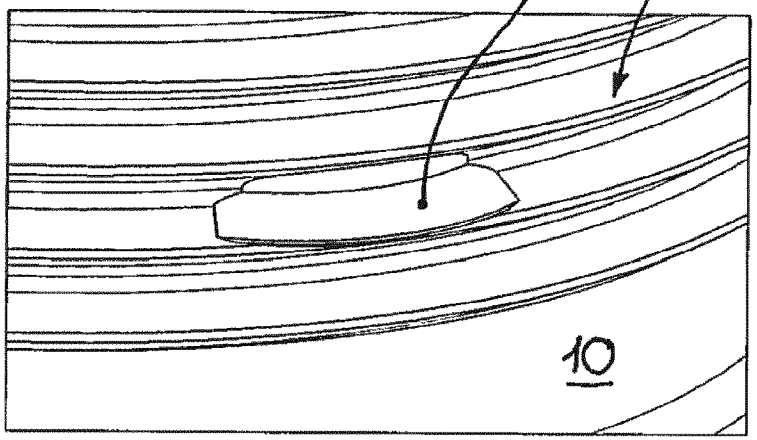
FIG. 5 shows the external thread of the jet regulator housing shown in FIG. 4, in a perspective view of a detail in the region of the cam-shaped moulding.
Figure 7:
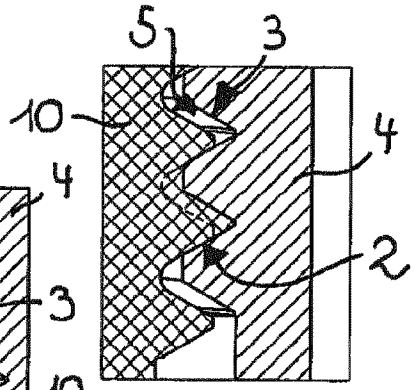
FIG. 7 shows the screw connection provided between the jet regulator from FIG. 6 and the water outlet, in a longitudinal section of a detail in the region of the cam-shaped moulding.
Figure 6:
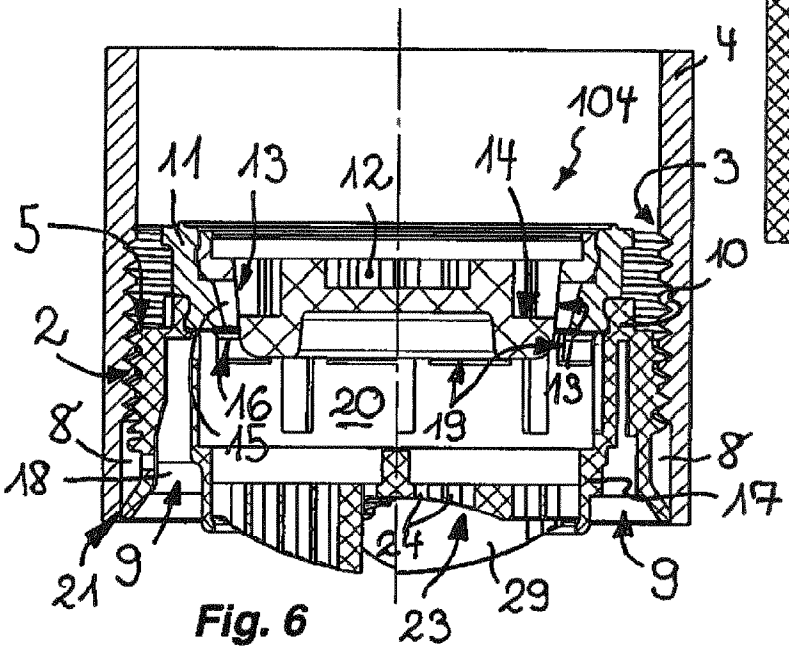
FIG. 6 shows the jet regulator equipped with the jet regulator housing from FIGS. 4 and 5 which by way of the external thread thereof is screw-fitted into an internal thread in the water outlet of a sanitary outlet fitting, wherein the jet regulator is illustrated in a longitudinal section through the section plane VI.-VI.
Figure 6A:
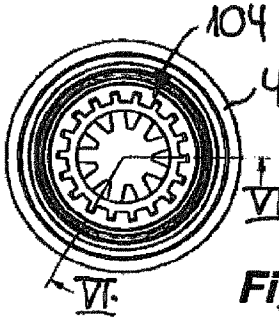
Figure 8:
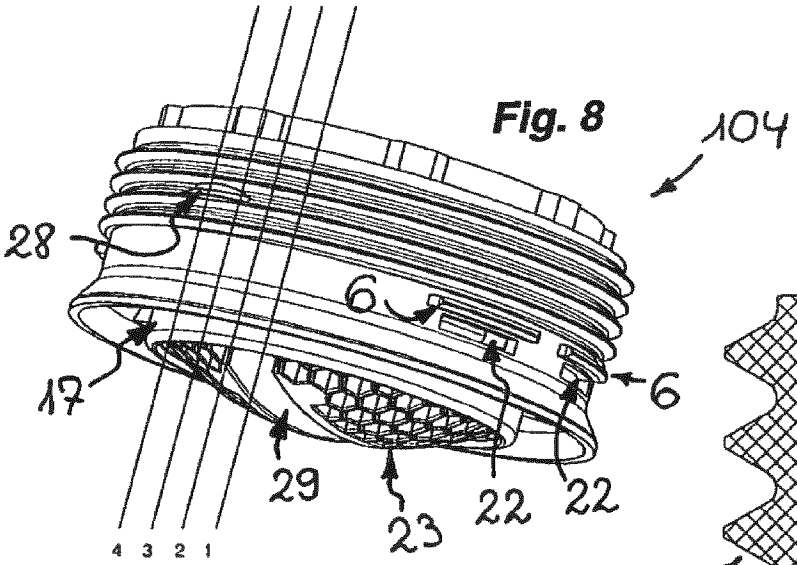
FIG. 8 shows the jet regulator from FIG. 6 having the jet regulator housing already shown in FIGS. 4 to 7.
Figure 10:
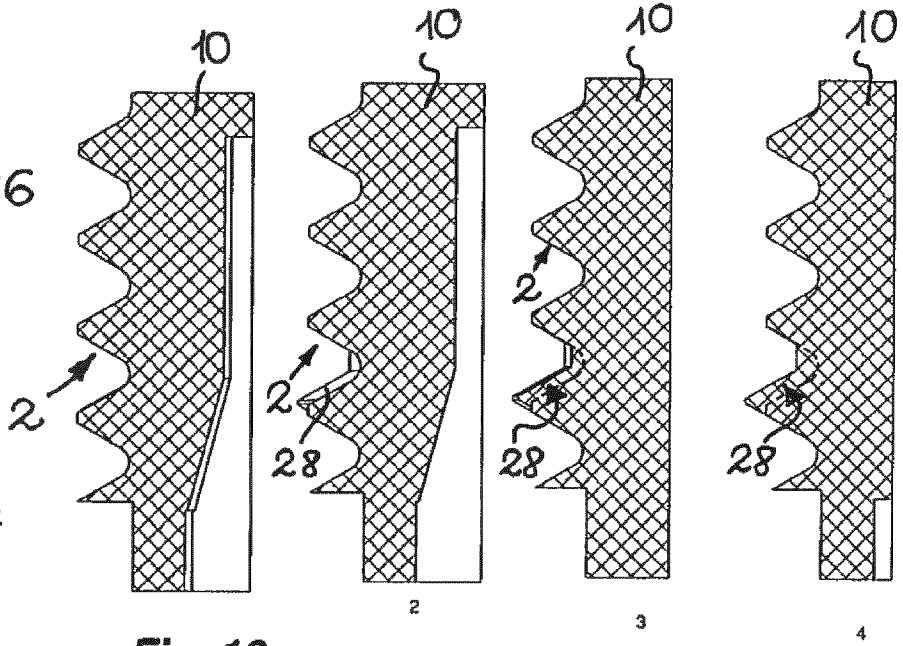
FIG. 10 shows the external thread on the jet regulator housing of the jet regulator shown in FIGS. 6, 8, and 9, said external thread being sectioned longitudinally in four angular positions, wherein the angular positions used for the longitudinal section are shown and sequentially numbered in FIGS. 8 and 9.
Figure 9:
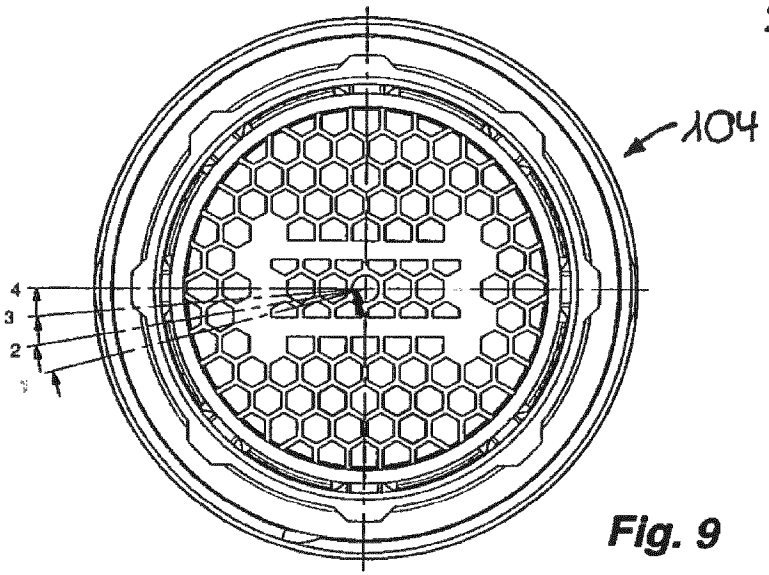
FIG. 9 shows the jet regulator from FIGS. 6 and 8 in a plan view of the outflow-side housing end face.
Figure 12:
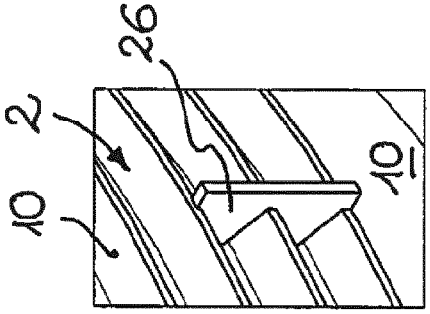
FIG. 12 shows the external thread provided on the housing external circumference of the jet regulator housing shown in FIG. 11 in a perspective view of a detail in the region of the separation wall that serves as a liquids bulkhead.
Figure 14:
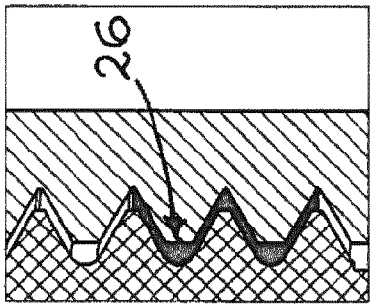
FIG. 14 shows the external thread of the jet regulator shown in FIG. 13 in a longitudinal section of a detail in the region of the separation wall shown in FIGS. 11 and 12, said external thread interacting with the internal thread in the water outlet.
Figure 11:
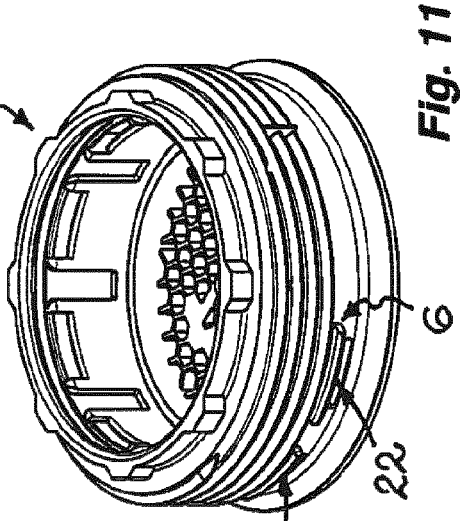
FIG. 11 shows the jet regulator housing of a further jet regulator, wherein at least one separation wall that projects beyond the external thread provided on the housing external circumference and is configured as a liquids bulkhead can be seen.
Figure 13A:
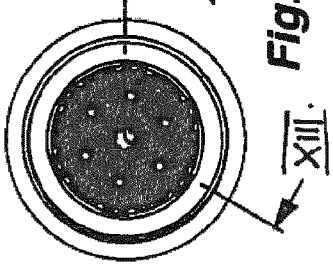
FIG. 13A shows the jet regulator in an inflow-side plan view.
Figure 13:
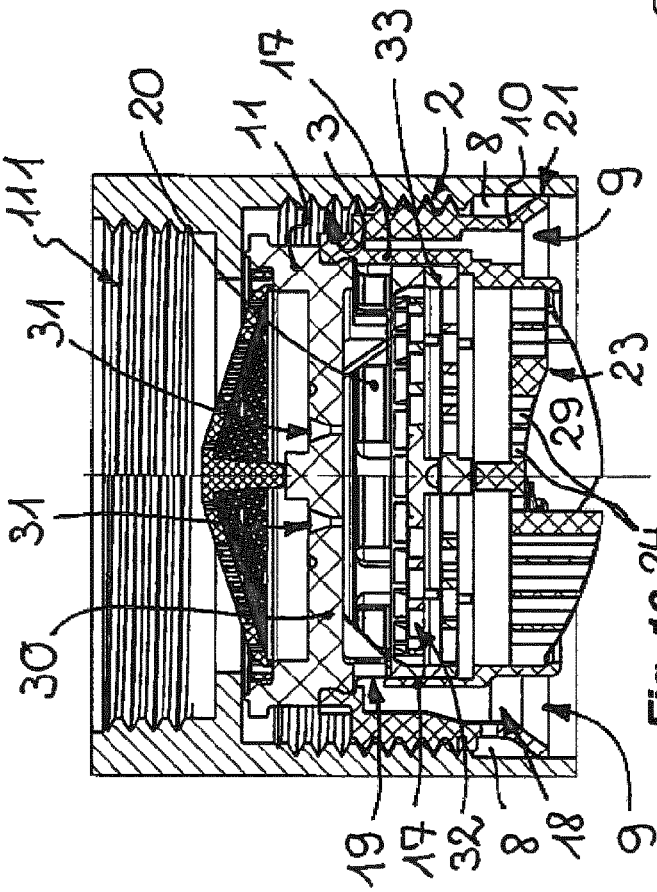
Figure 16:
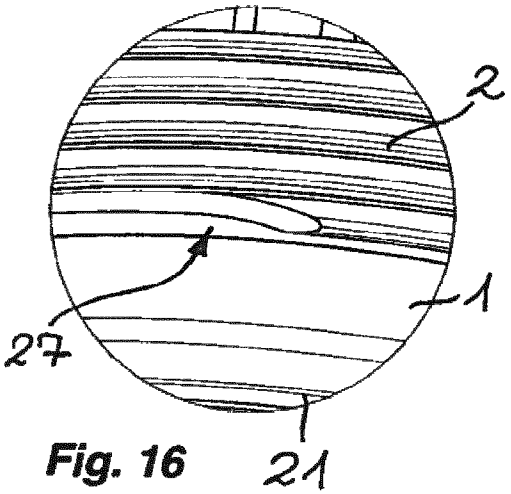
FIG. 16 shows the external thread of the jet regulator shown in FIG. 15 in a perspective view of a detail in the region of the deviation in the external thread.
Figure 15:
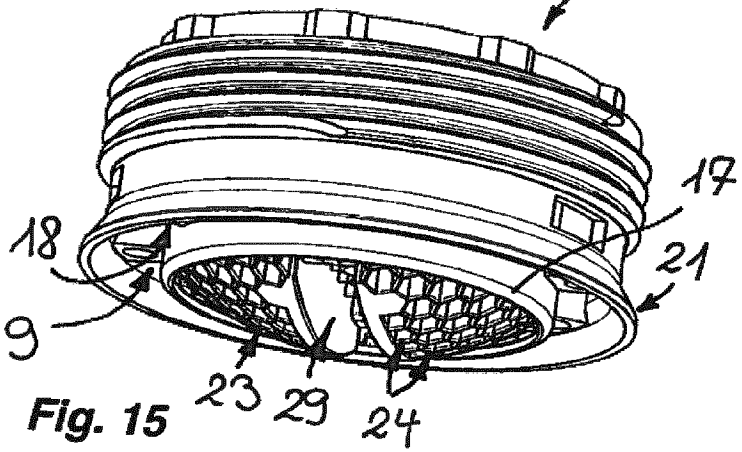
FIG. 15 shows a further jet regulator, the external thread thereof provided on the housing external circumference in an outflow-side part-region having in regions a thread profile that deviates from a thread groove that in a helical manner continuously encircles a cylindrical wall, wherein said deviation in the thread profile can in a sealing manner cut into the internal thread in the water outlet.
Figure 18:
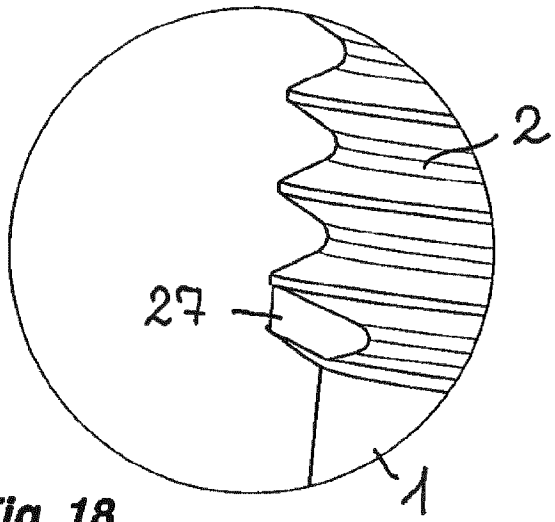
FIG. 18 shows the jet regulator already shown in FIGS. 15 to 17 in a perspective view of a detail in the region of the thread profile of the external thread that on the outflow side is designed in a deviating manner.
Figure 17:
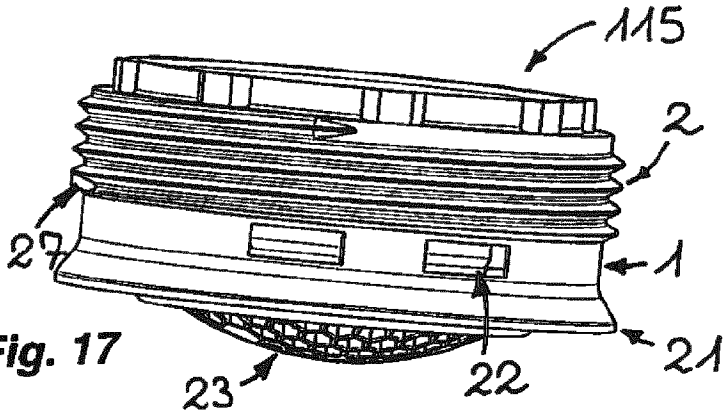
FIG. 17 shows the jet regulator from FIGS. 15 and 16 in a perspective lateral view.
Figures 19, 20, 21:
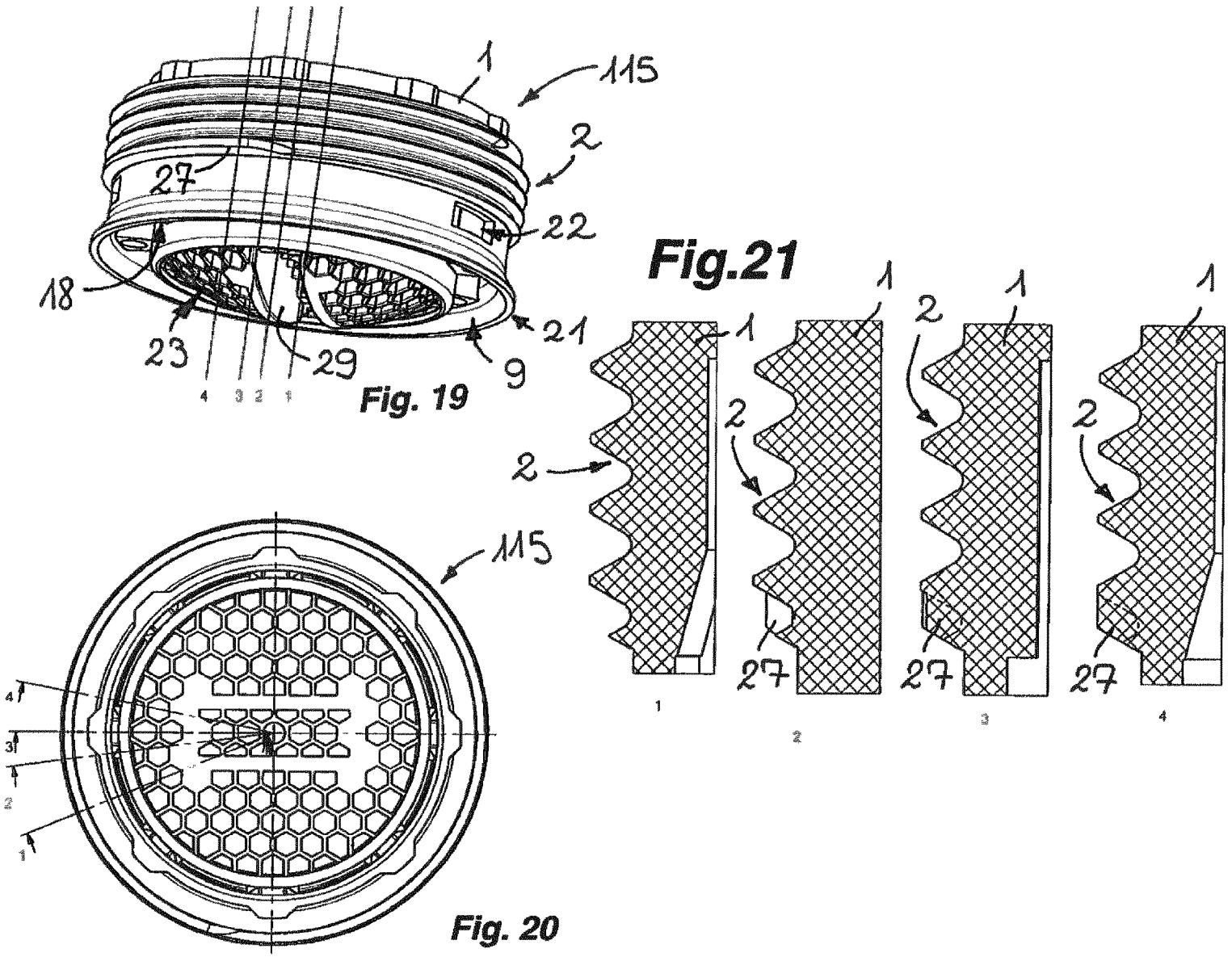
FIG. 19 shows the jet regulator from FIGS. 15 to 18 in a perspective view from below.
FIG. 20 shows the jet regulator from FIGS. 15 to 19 in a plan view of the outflow side housing end face of the jet regulator housing.
FIG. 21 shows the external thread sectioned longitudinally in four different angular positions, wherein the angular positions shown are sequentially numbered and illustrated in more detail in FIGS. 19 and 20.
Figure 22:
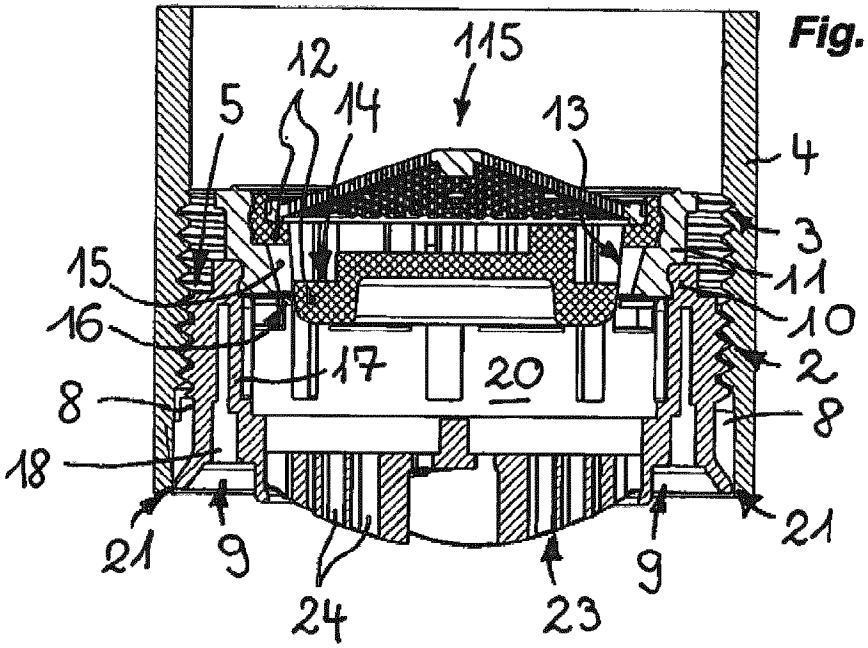
FIG. 22 shows the jet regulator shown in FIGS. 15 to 21 in a longitudinal section in the water outlet of a sanitary outlet fitting.
Figure 24:
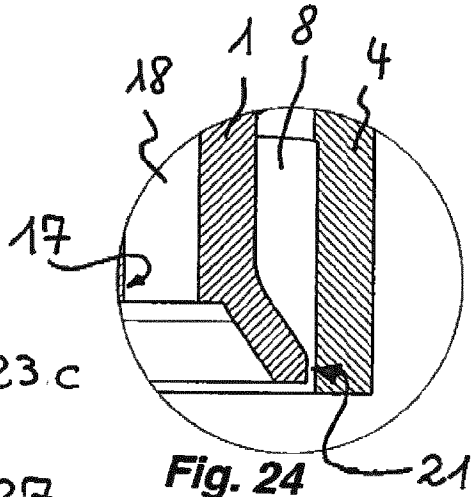
FIG. 24 shows the jet regulator housing of the jet regulator shown in FIGS. 15 to 22 in a longitudinal section of a detail in the region of the drainage annular space.
Figure 23C:
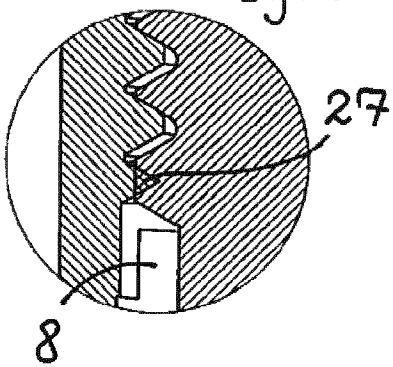
Figure 23B:
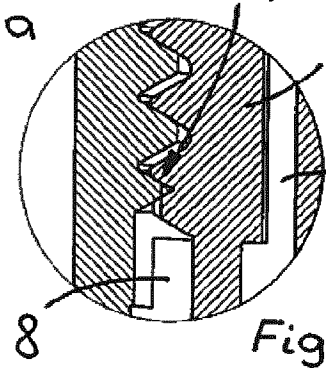
Figure 23A:
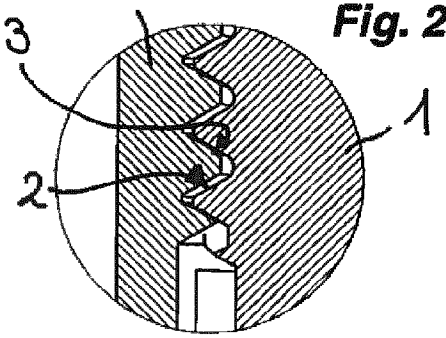
Figure 25:
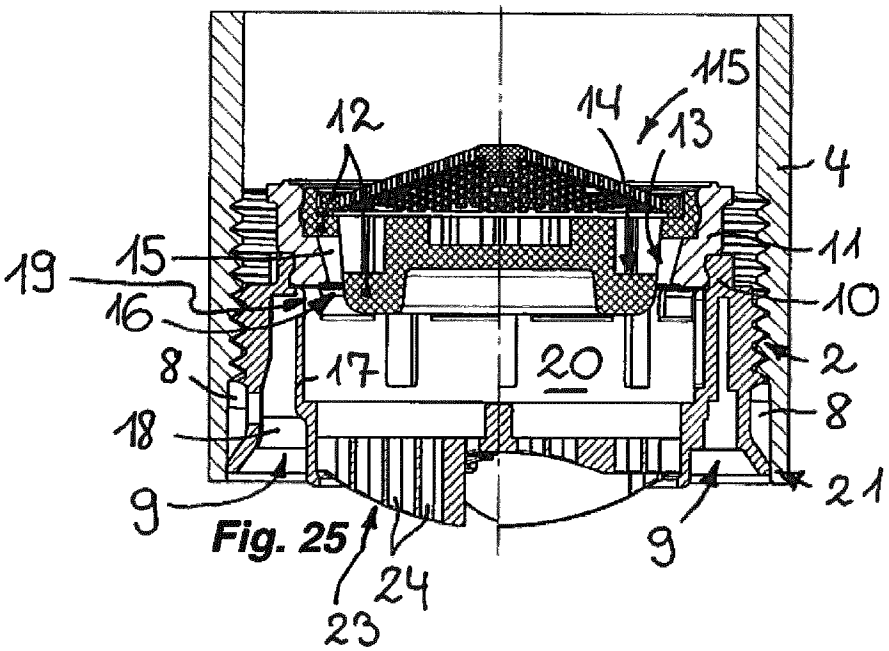
FIG. 25 shows the jet regulator from FIGS. 15 to 22 screw-fitted into the water outlet of a sanitary outlet fitting, in a longitudinal section through the section plane XXV.-XXV. according to FIG. 26.
Figure 26:
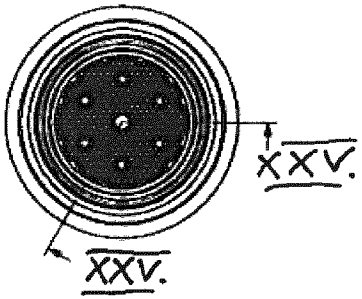
FIG. 26 shows the jet regulator from FIGS. 15 to 22 and 25 in a plan view of the inflow side of said jet regulator and of the ancillary filter provided thereon at the inflow side.

In order for the external thread 2 to be designed having a thread profile that deviates from a thread groove that in a helical manner continuously encircles a cylindrical wall, the external envelope circle of the external thread on the jet regulator housing that is specified for screw-fitting to the internal thread 3 moulded in the cylindrical water outlet 4 in the case of the jet regulator shown in FIGS. 1 to 3 conically widens towards the outflow side. The external thread 2 that is configured so as to be conical towards the outflow side in FIG. 2 is shown in a position in which the jet regulator 101 is screw-fitted into the internal thread. By virtue of the conicity of the external thread 2, the inflow-side topmost thread turn sits in the internal thread 3 so as to still have some clearance, while the next-but-one thread turn in relation to the topmost thread turn, on account of the conicity of the external thread that commences there, projects deeper into the thread groove of the internal thread 3. The outflow-side last thread turn of the external thread 2 almost completely closes the assigned thread groove of the internal thread 3 so that leakage water can no longer seep through by way of said screw connection.

A further deviation of the thread profile forming the external thread 2 is shown in the case of the jet regulator 104 according to FIGS. 4 to 10. In the case of this jet regulator, a cam-shaped moulding 28 which in one of the thread grooves of the external thread extends approximately in the groove longitudinal direction is configured on the external thread 2 provided on the housing external circumference. Said cam-shaped moulding 28 projects beyond the envelope circle enveloping the external thread 2. When screw-fitting the external thread 2 in the internal thread 3, the cam-shaped moulding 28 seals in the groove base of the neighbouring internal thread 3, on the flanks of said internal thread 3, and at the tip of the thread profile once the cam-shaped moulding 28 has cut deep into the internal thread 2.

A further deviation in the thread profile forming the external thread 2 is implemented in the case of the jet regulator 111 illustrated in FIGS. 11 to 14. At least one moulding which serves as liquids bulkhead and which projects into at least one thread groove of the external thread 2 is also provided on the housing external circumference of the jet regulator housing 1 in the case of the jet regulator 111. However, said at least one moulding here is configured as a separation wall 26 which extends across at least two thread grooves of the external thread 2 and which runs approximately axially parallel to the housing longitudinal axis of the jet regulator housing 1. Since this moulding configured as the separation wall 26 projects far beyond the envelope circle enveloping the external thread 2, this moulding simultaneously also represents a cross-sectional widening which projects beyond the adjacent regions of the jet regulator housing, and which is materially identical with the housing portion of the jet regulator housing 1 that supports the external thread 2, and which is moulded so as to be integral thereto, and which bears in a sealing manner on the internal circumferential side of the water outlet 4 and prevents any seepage of leakage water by way of the screw connection.

The external thread 2 is configured as a thread profile which at least in regions deviates from a thread groove that in a helical manner continuously encircles a cylindrical wall also in the case of the jet regulator 115 shown in FIGS. 15 to 26. To this end, the thread profile of the external thread which projects beyond the thread groove in an outflow-side thread portion widens at least in regions and in this way forms a sealing wedge 27 which is illustrated in more details in FIGS. 15 to 18. It is shown in FIGS. 23A to 23C how the moulding of the thread profile forming the external thread 2 that is configured as the sealing wedge 27 cuts increasingly into the internal thread 3 of the outlet fitting when screw-fitting the external thread 2. While the external thread 2 in FIG. 23A is not yet completely screw-fitted into the internal thread 3, and the moulding configured as the sealing wedge 27, has not yet been cut, it is shown in FIG. 23B how said moulding starts to increasingly cut into the internal thread 3 when driving the external thread 2 further into the latter. The jet regulator in FIG. 23C is completely assembled, and the moulding configured as the sealing wedge 27 is completely engaged with the internal thread 3. The overlapping hatched area in FIG. 23C indicates that the material of the moulding provided in the external thread 2 and/or of the internal thread 3 is displaced herein.

Figure 29:
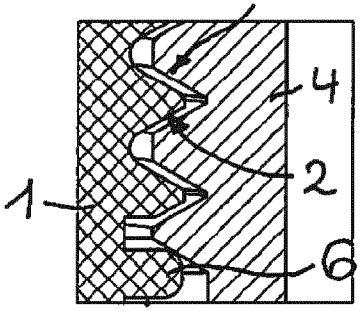
FIG. 29 shows the jet regulator from FIG. 28 in a longitudinal section through a detail of the screw connection between the jet regulator housing, on the one hand, and the internal thread provided in the water outlet, on the other hand.
Figure 27:
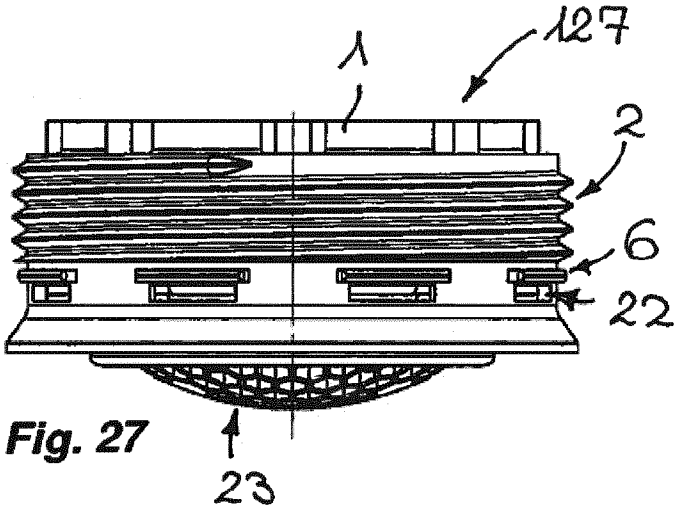
FIG. 27 shows a further jet regulator in a lateral view in which the drainage annular space by way of drainage openings is connected to an aeration duct that runs in an encircling manner in the housing interior, wherein flange-type cross-sectional widenings which delimit an ingress of leakage water into the drainage annular space project above the drainage openings.
Figure 28:
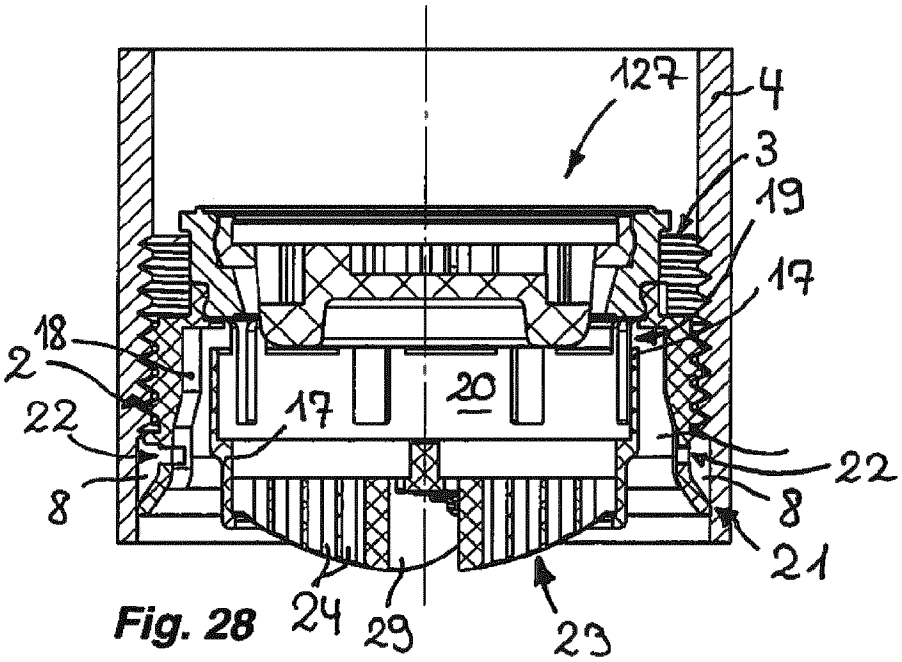
FIG. 28 shows the jet regulator completed while using the jet regulator housing shown in FIG. 27 in a longitudinal section.

It is shown by means of the jet regulators 127 and 130 that the jet regulator housing 1 on the housing external circumference thereof can also have at least one cross-sectional widening 6; 7 which is materially identical to the housing portion of the jet regulator housing 1 that supports the external thread 2 and is moulded so as to be integral thereto, and which is capable of being brought to bear in a sealing manner on the end side and/or internal circumferential side of the water outlet 4. These cross-sectional widenings 6; 7 in the case of the jet regulators 127 and 130 are configured in a flange-type manner and in the housing circumferential direction of the jet regulator housing 1 extend across at least one of the drainage openings 22. The flange-type cross-sectional widenings 6; 7 on the housing external circumference of the jet regulator housing 1 of the jet regulators 127, 130 are provided between the external thread 2 and the at least one drainage opening 22. While the flange-type cross-sectional widenings 6 in the case of the jet regulator 127 shown in FIGS. 27 to 29 are in each case disposed on the inflow side directly above one of the drainage openings 22, the jet regulator 130 shown in FIGS. 30 to 32 by contrast has a flange-type cross-sectional widening 7 which is configured as an annular flange that encircles the jet regulator housing 1. The flange-type cross-sectional widenings 6; 7 on the jet regulators 127, 130 here too are configured as a screw-fitting detent which delimits the screw-fitting of the external thread 2 into the internal thread 3 in the water outlet 4 of the outlet fitting. The cross-sectional widenings are capable of being brought to bear in a sealing manner on the outlet end side or, as here, on the internal circumference of the water outlet.

The jet regulators shown here are distinguished by a high degree of sealing in the region of the annular zone 5 that is situated between the housing external circumference of the jet regulator housing 1 and the internal circumference in the water outlet 4 of the outlet fitting, without separate and in particular materially dissimilar annular seals being required for sealing. The jet regulators 101, 104, 111, 115, 127, and 130 illustrated here are therefore configured so as to be free of an annular seal and make do without an annular seal that is produced from an elastic material so as to be separate from the jet regulator housing 1.

LIST OF REFERENCE SIGNS

Figure 32:
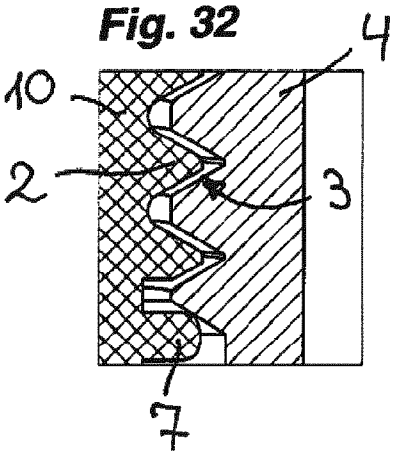
FIG. 32 shows the screw connection provided between the external thread on the jet regulator housing, on the one hand, and the internal thread in the water outlet, on the other hand, in a longitudinal section of a detail in the region of the cross-sectional widening that encircles the jet regulator housing in the manner of a flange.
Figure 30:
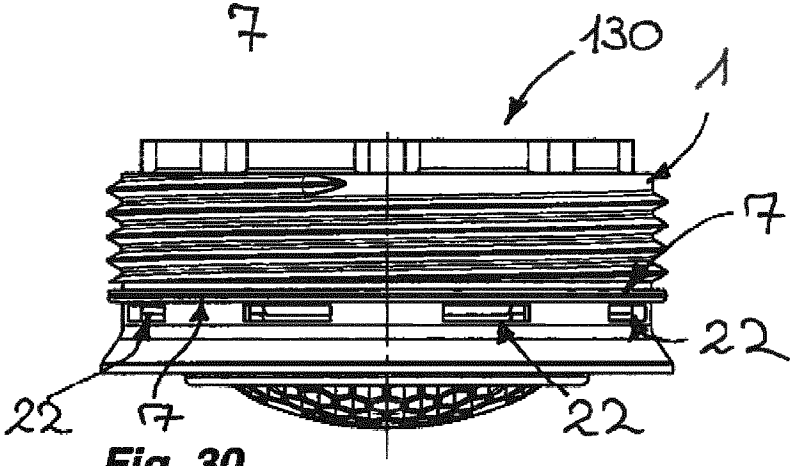
FIG. 30 shows a jet regulator in a lateral view, wherein the jet regulator shown here has a flange-type cross-sectional widening which is disposed above drainage openings and which encircles the jet regulator housing on the external circumference.
Figure 31:
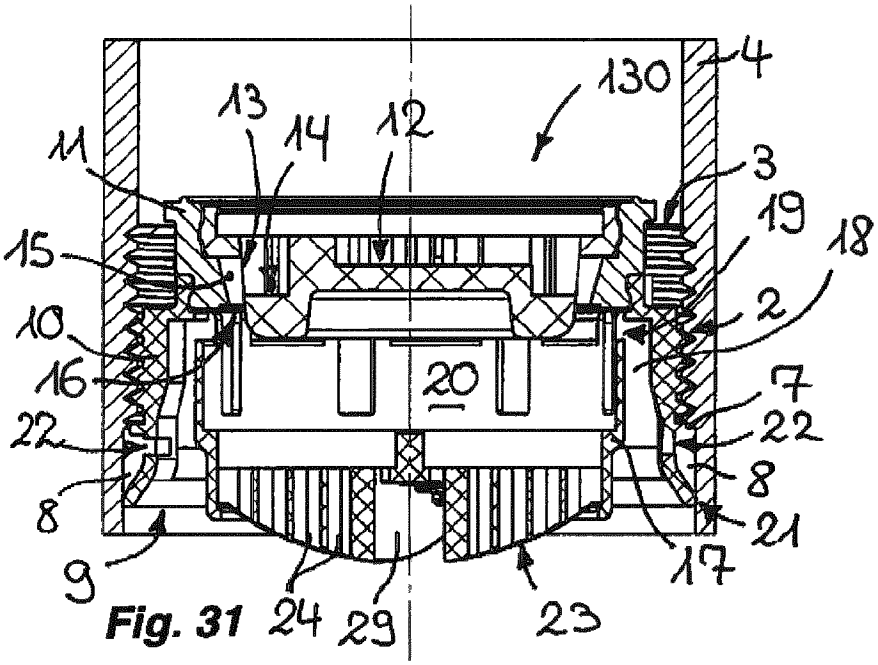
FIG. 31 shows the jet regulator from FIG. 30 in a longitudinal section.

1 Jet regulator housing
2 External thread
3 Internal thread
4 Water outlet
5 Annular zone
6 Flange-type cross-sectional widening (on the jet regulator 127 according to FIGS. 27 to 29)
7 Encircling flange-type cross-sectional widening (on the jet regulator 130 according to FIGS. 30 to 32)
8 Drainage annular space
9 Aeration opening
10 First outflow-side housing part
11 Second housing part
12 Jet splitter insert
13 Splitter openings
14 Cup base
15 Annular gap (in the jet splitter)
16 Annular opening (of the annular gap 15)
17 Guide wall
18 Aeration duct
19 Duct opening
20 Mixing zone
21 Lip seal
22 Drainage opening
23 Mesh or net structure
24 Throughflow openings
26 Separation wall
27 Sealing wedge
28 Cam-shaped moulding
29 Recess
30 Perforated plate
31 Splitter openings
32 Insert part
33 Insert part
101 Jet regulator according to FIGS. 1 to 3
104 Jet regulator according to FIGS. 4 to 10
111 Jet regulator according to FIGS. 11 to 14
115 Jet regulator according to FIGS. 15 to 26
127 Jet regulator according to FIGS. 27 to 30
130 Jet regulator according to FIGS. 30 to 32

The invention claimed is:

1. A jet regulator (101, 104, 111, 115, 127, 130) comprising:

a jet regulator housing (1) which on a housing external circumference thereof, spaced apart from an outflow-side housing end side, has an external thread (2) adapted for screw-fitting into an internal thread (3) in a water outlet (4) of a sanitary outlet fitting;

a sleeve-shaped guide wall (17) in the jet regulator housing (1), at least one aeration duct (18) which extends from at least one aeration opening (9) that is disposed on the housing outflow side or on the housing circumference to the housing interior, and the at least one aeration duct is located between the housing internal circumference of the jet regulator housing (2) and the guide wall (17);

a housing part-region of the jet regulator housing (1) that is disposed on an outflow side of the external thread (2) and is angled in a direction towards an internal circumference of the water outlet (4) such that a drainage annular space (8) is formed between said housing part-region and an internal circumference of the water outlet (4), wherein the drainage annular space (8) collects leakage water which makes its way up to the housing part-region thereby preventing leakage water from exiting an annular zone located between the housing external circumference and the internal circumference of the water outlet; and at least one drainage opening (22) which from the drainage annular space (8) leads to at least one of the aeration ducts (18), and the at least one drainage opening is located in a partial-region of the housing wall of the jet regulator housing (1) that is disposed between the outflow-side housing end side and the external thread (2).

2. The jet regulator according to claim 1, wherein an outflow-side housing end periphery of the jet regulator housing (1) is configured as a lip seal (21) which is configured to bear on the internal circumference of the water outlet (4).

3. The jet regulator according to claim 1, wherein the jet regulator (101, 104, 111, 115, 127, 130) is configured as a jet aerator which is configured to mix water flowing therethrough with ambient air, and a housing portion of the jet regulator housing (1) that is disposed on the outflow side of the external thread (2), has the at least one aeration opening (9) that is provided on a circumference of the housing or on a housing end side of the jet regulator housing (1).

4. The jet regulator according to claim 3, wherein the jet regulator housing (1) is formed from at least first and second housing parts (10, 11) that are connectable to one another.

5. The jet regulator according to claim 4, wherein the first housing part (10) that is disposed on the outflow side supports the external thread (2).

6. The jet regulator according to claim 5, wherein the outflow-side first housing part (10) on an inflow side thereof is connectable to the second housing part (11) of the jet regulator housing (1), said second housing part (11) supporting a jet splitter which is configured to split water flowing therethrough into a multiplicity of individual jets.

7. The jet regulator according to claim 6, wherein the jet regulator is configured as a diffuser which has a cup-shaped jet splitter insert (12) which on a cup circumference of a cup shape thereof has a plurality of splitter openings (13) and which has a cup base (14) which is configured as an impact face that is configured to deflect inflowing water towards the splitter openings (13).

8. The jet regulator according to claim 7, wherein the second housing part (11) encompasses the jet splitter insert (12), and the second housing part (11) at least in region of the splitter openings (13), tapers in such that an annular gap (15) which on the outflow side tapers towards an annular opening (16) that opens into a housing interior is formed between the jet splitter insert (12) and a housing internal circumference of the second housing part (11).

9. The jet regulator according to claim 1, wherein the jet regulator housing (1) on the housing external circumference thereof as the external thread (2), has a thread profile which at least in regions deviates from a thread groove that in a helical manner continuously encircles a cylindrical wall and which in said region deviated from the thread groove, is adapted to interact in a matingly engagable manner with an internal thread (3) provided in the water outlet (4).

10. The jet regulator according to claim 1, wherein the jet regulator housing (1) has at least one cross-sectional widening (6, 7) which is materially identical and moulded so as to be integral to a housing portion of the jet regulator housing (1) that supports the external thread (2), which cross-sectional widening (6, 7) is adapted to be brought to bear on at least one of an end side or the internal circumferential side of the water outlet (4).

11. The jet regulator according to claim 1, wherein an external circumference of the external thread (2) on the jet regulator housing (1) that is specified for screw-fitting into the in the cylindrical internal thread widens conically towards the outflow side.

12. The jet regulator according to claim 1, further comprising at least one moulding (26, 28) which serves as a liquids bulkhead and which projects into at least one thread groove of the external thread (2) provided on the housing external circumference of the jet regulator housing (1).

13. The jet regulator according to claim 12, wherein the at least one moulding (26, 28) reaches up to an envelope circle enveloping the external thread (2) or at least in regions projects beyond said envelope circle.

14. The jet regulator according to claim 12, wherein the at least one moulding is configured as a separation wall (26) that extends across at least two neighbouring thread grooves of the external thread.

15. The jet regulator according to claim 14, wherein the at least one separation wall (26) extends approximately axially parallel to a housing longitudinal axis of the jet regulator housing (1).

16. The jet regulator according to claim 12, wherein the at least one moulding (28) is cam-shaped, and the cam-shaped moulding (28) in the thread groove extends approximately in a groove longitudinal direction.

17. The jet regulator according to claim 1, wherein thread profile of the external thread (2) that projects beyond the thread groove widens at least in regions.

18. The jet regulator according to claim 10, wherein the at least one cross-sectional widening (6; 7) projects with a flange shape on the housing external circumference of the jet regulator housing (1).

19. The jet regulator according to claim 18, wherein the at least one flange-shaped cross-sectional widening (6; 7) in the housing circumferential direction of the jet regulator housing extends across at least one drainage opening (22).

20. The jet regulator according to claim 19, wherein the at least one flange-shaped cross-sectional widening (6; 7) on the housing external circumference of the jet regulator housing is provided between the external thread and the at least one drainage opening (22).

21. The jet regulator according to claim 19, wherein the flange-shaped cross-sectional widening (7) is configured as an annular flange that encircles the jet regulator housing (1).

22. The jet regulator according to claim 19, wherein the at least one flange-shaped cross-sectional widening (6; 7) is configured as a screw-fitting detent which delimits a screw-fitting of the external thread (2) into the internal thread (3) in the water outlet (4) of the outlet fitting.

23. The jet regulator according to claim 1, further comprising a mesh or a net structure (23) formed from webs (24, 25) that intersect one another at intersection nodes (23) integrally moulded to the guide wall (17) on the outflow side.

24. The jet regulator according to claim 23, wherein the guide wall (17) is connected rotationally fixed to the jet regulator housing (1) on the outflow side, and at least one tool engagement face for a driving tool is provided on at least one of the guide wall (17) or on the mesh or net structure (23).

25. The jet regulator according to claim 24, wherein the at least one tool engagement surface comprises at least one slot-shaped recess (29) which is delimited by opposite slot longitudinal walls which form tool engagement faces for insertion of the driving tool in the mesh or net structure.

26. The jet regulator according to claim 1, wherein the jet regulator (101, 104, 111, 115, 127, 130) is designed to be free of and is adapted to be installed without an annular seal that is produced from an elastic material so as to be separate from the jet regulator housing (1).

27. The jet regulator according to claim 6, wherein the jet splitter is configured as a perforated plate (30) which has splitter openings (31).

28. The jet regulator according to claim 27, wherein the splitter openings (31) at least in regions taper in a throughflow direction.

29. The jet regulator according to claim 28, further comprising an insert part (32, 33) disposed downstream in a flow direction of the jet splitter and spaced apart therefrom, said insert part (32, 33) having a mesh or net structure from webs that intersect one another at intersection nodes.

30. The jet regulator according to claim 29, wherein the mesh or net structure that is provided in the at least one insert part (32, 33) has throughflow openings (24).

31. The jet regulator according to claim 30, wherein the throughflow openings (24) have at least one of honeycomb-shaped or hexagonal opening cross sections.

32. The jet regulator according to claim 29, wherein the mesh or net structure provided in the insert part (32, 33) has at least two first webs which at the intersection nodes intersect a group of second webs.

33. The jet regulator according to claim 32, wherein the mesh or net structure is formed from at least two concentrically encircling webs which are connected to a group of radial webs.

34. The jet regulator according to claim 29, wherein the mesh or net structure that is provided in the at least one insert part (32, 33) is formed by a group of axially parallel first webs which intersect a group of axially parallel second webs which are disposed at an angle in relation to said group of axially parallel first webs.

35. The jet regulator according to claim 29, wherein the mesh or net structure that is provided in the at least one insert part (32, 33) are formed from webs which are mutually disposed at an angle such that the mesh or net structure is formed in an ornamental manner from non-uniformly shaped throughflow openings.

* * * * *